United States Patent [19]

King

[11] 4,294,083

[45] Oct. 13, 1981

[54] AIR CONDITIONING SYSTEM

[76] Inventor: Barton King, 19415 W. Indies La., Tequesta, Fla. 33458

[21] Appl. No.: 137,870

[22] Filed: Apr. 7, 1980

[51] Int. Cl.[3] ..... F25D 17/02

[52] U.S. Cl. ..... 62/434; 62/59; 62/201

[58] Field of Search ..... 62/59, 96, 201, 430, 62/434, 435

[56] References Cited

U.S. PATENT DOCUMENTS

| | | | |
|---|---|---|---|
| 2,722,108 | 11/1955 | Hailey | 62/59 |
| 2,893,218 | 7/1959 | Harnish | 62/434 |
| 3,271,968 | 9/1968 | Karnath | 62/435 |
| 3,653,221 | 4/1972 | Angus | 62/59 |
| 3,672,183 | 6/1972 | Bernstein | 62/59 |
| 4,129,014 | 12/1978 | Chubb | 62/59 |

OTHER PUBLICATIONS

Mechanix Illustrated/Sep. 1979: "Using Ice to Store Cooling Power", pp. 33–38.

*Primary Examiner*—Ronald C. Capossela
*Attorney, Agent, or Firm*—Jack N. McCarthy

[57] ABSTRACT

An air conditioning system has a freeze tank with a first coolant tank positioned therein with means for freezing a liquid in said freeze tank around said first coolant tank at a predetermined low temperature and cooling a specially prepared coolant as a liquid in the first coolant tank to the same low temperature; a second coolant tank contains a coolant connected to an evaporator coil in a duct means wherein flow from said second coolant tank through said evaporator coil provides for cooling air through said duct means when desired; heat absorber plates being located in said second coolant tank with means connecting said first coolant tank to said heat absorber plates for flowing the specially prepared coolant therethrough when desired.

9 Claims, 1 Drawing Figure

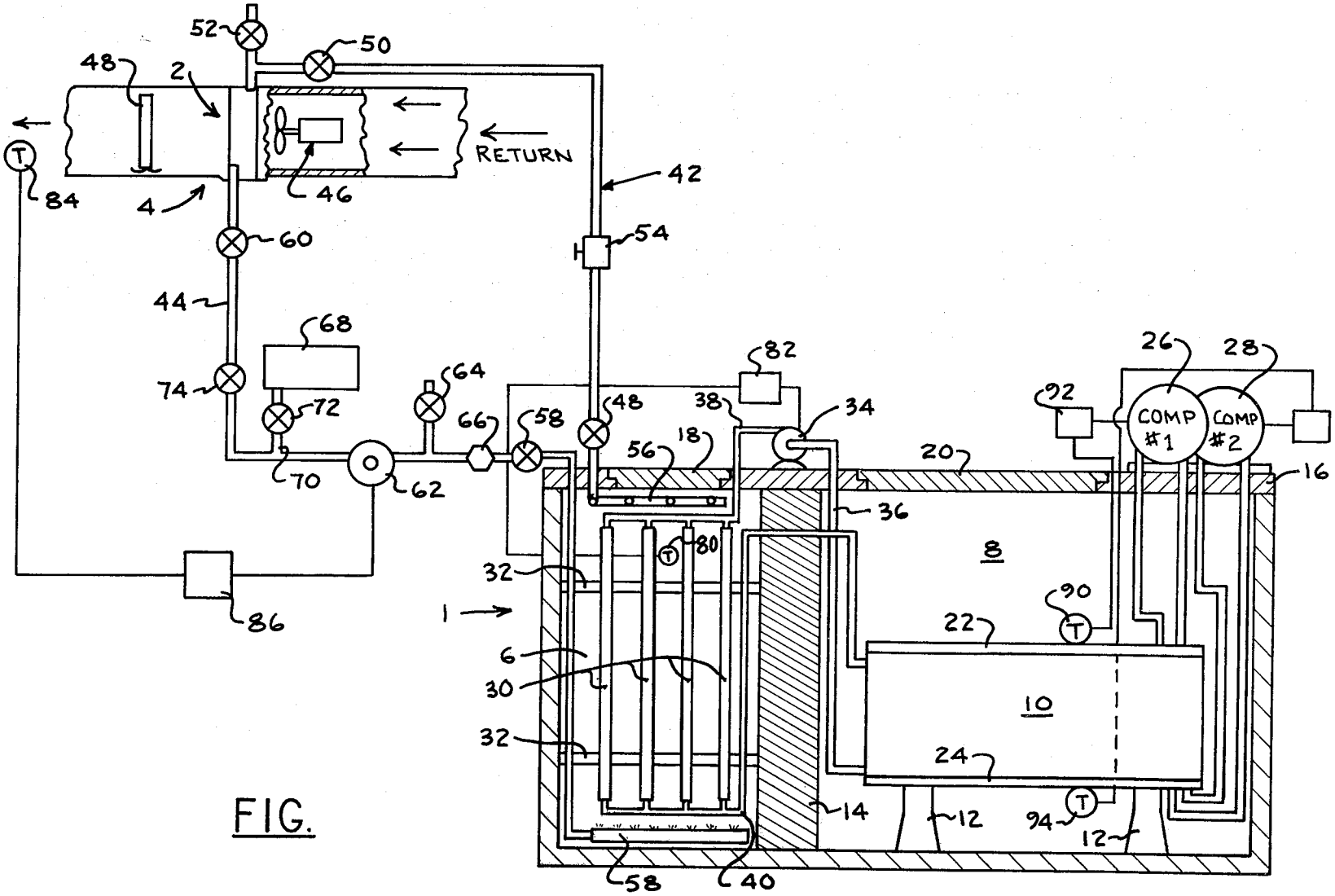
FIG.

AIR CONDITIONING SYSTEM

BACKGROUND OF THE INVENTION

This invention relates to an air conditioning system and more particularly to those having freeze tanks using ice to store cooling power.

Generally, in the past, devices have been used wherein a coolant is partially frozen and the part remaining liquid is used as a coolant. An article describing one of these systems is shown in the September, 1979 issue of Mechanix Illustrated.

Patents which are related to devices of this type are set forth below: U.S. Pat. No. 2,097,556; U.S. Pat. No. 2,158,707; U.S. Pat. No. 2,448,453; and U.S. Pat. No. 2,737,027.

SUMMARY OF THE INVENTION

An object of this invention is to provide an air conditioning system which will require less horsepower to produce a predetermined number of BTU's than existing systems.

Another object of this invention is to provide an air conditioning system having a liquid coolant tank having a coolant which will reach very low temperatures without freezing while a freeze tank around said coolant tank is frozen solid, allowing the coolant from the coolant tank to flow through heat absorber plates in a second coolant tank, said second coolant tank having its liquid directed to an evaporator coil.

A further object of this invention is to provide an air conditioning system wherein (1) the size of the freeze tank to its enclosed coolant tank, (2) the size of the enclosed collant tank to its heat absorber plates, and (3) the size of a second coolant tank to the flow through an evaporator coil to achieve the desired amount of BTU cooling per hour, can be varied to achieve the desired size of a system to arrive at a specific output.

BRIEF DESCRIPTION OF THE DRAWINGS

The FIGURE shown is a schematic of the air conditioning system.

DESCRIPTION OF THE PREFERRED EMBODIMENT

The FIGURE shows a tank means 1 for providing a coolant which can be pumped through an evaporator coil 2 located in a duct system 4 wherein a cooled flow of air can be delivered to various locations. The tank means 1 is divided into two tanks, a coolant tank 6 and a freeze tank 8, with a third coolant tank 10 being located within freeze tank 8 and mounted away from the bottom of the tank 8 by standoff members 12, permitting a liquid in tank 8 to surround tank 10. The walls of the tank means 1 are well insulated, as is the partition 14 within the tank means 1, which divides the tank means 1 into the two tanks 6 and 8. The top 16 of the tank means 1 is also well insulated and provided with an insulated door 18 which enters into coolant tank 6 and insulated door 20 which enters into freeze tank 8.

The tank 10 contains a coolant which is a mixture of water and chemicals which will allow the mixture to reach very low temperatures, such as −40° F. (−40° C.) without freezing, while freeze tank 8 contains water which will freeze around tank 10. A freeze plate 22 is positioned on the top of tank 10 and a freeze plate 24 is positioned on the bottom of the tank 10 to freeze the water in freeze tank 8 and cool the liquid coolant in tank 10. One compressor unit 26 is mounted on the top of the tank means 1 and is connected to the freeze plate 22 and a second compressor unit 28 is mounted on the top of the tank means 1, next to said one compressor unit 26, and is connected to the freeze plate 24. A temperature responsive device 90 is placed adjacent freeze plate 22 to record a temperature in a desired location and is connected to control means 92 which will control the compressor unit 26 to turn it "on" or "off" as called for by the temperature sensor 90.

A second temperature responsive device 94 is placed adjacent freeze plate 24 to record a temperature in a desired location and is connected to control means 96 which will control the compressor unit 28 to turn it "on" or "off" as called for by the temperature sensor 94. These temperature sensors 90 and 94 can be set for the same temperature, or at different temperatures, to obtain the desired cooling from freeze plates 22 and 24.

The tank 6 contains water as a coolant and has a plurality of heat absorber plates 30 which are fixedly mounted to the sides thereof by a plurality of standoff rods 32. The bottom of the tank 10 is connected to the inlet of a pump 34 by a conduit 36; pump 34 is mounted on the top 16 of the tank means 1, above the partition 14 between the two tanks 6 and 8. The outlet of the pump 34 is connected to the top of the heat absorber plate 30 by a conduit 38. The bottoms of the heat absorber plates 30 are connected to the top of the tank 10 by a conduit 40. This permits the coolant in tank 10 to be pumped from tank 10, through the heat absorber plates 30 in tank 6, and back to tank 10, when desired.

Cooled water is directed from tank 6 to the evaporator coil 2 in duct system 4 by a first conduit means 42 and is returned from the evaporator coil 2 to the tank 6 by a second conduit means 44. An evaporator fan 46 is located in said duct system 4 for blowing the air in said duct over said evaporator coil. A dehumidifier 48 can be installed in the duct system as required.

The conduit means 42 is connected to an Inlet manifold 56 in the top of tank 6 and includes an on-off valve 48 adjacent the tank means 1, and an on-off valve 50 near the evaporator coil 2. An air relief valve 52 is located between said on-off valve 50 and the inlet to the evaporator coil 2. Valve means 54 is located between on-off valve 48 and on-off valve 50 to control the desired volume of liquid flow to the evaporator coil 2.

The conduit means 44 is connected to an outlet manifold 58 in the bottom of tank 6 and includes an on-off valve 58 adjacent the tank means 1 and an on-off valve 60 adjacent the outlet of the evaporator coil 2. A pump 62 is located in the conduit means 44 for pumping the coolant from tank 6 through said evaporator coil 2 and back to the tank 6. An air relief valve 64 is positioned just downstream of the outlet of the pump and a sighting glass 66 is positioned between the air relief valve 64 and on-off valve 58. A water supply means 68 is connected by a conduit 70, with valve means 72, to conduit means 44 upstream of the pump 62 for directing water to the system when desired. Another on-off valve 74 is located just upstream of the connection of conduit 70 into the conduit means 44.

A temperature responsive device 80 is placed in the tank 6 to record its temperature in a desired location and is connected to temperature control means 82 which will control the pump 34 to turn it "on" or "off" as called for by the temperature sensor 80 in tank 6. A temperature sensor 84 is placed in the area being cooled by the air flowing through the duct system 4 and is connected to temperature control means 86 which will control the pump 62 to turn it "on" or "off" as called for by the temperature sensor 84.

OPERATION

When temperature sensor 84 calls for cool air from duct system 4, pump 62 is turned on by temperature control means 86. This pump 62 then pumps the desired flow of cooling water from tank 6 through control valve means 54 to evaporator coil 2 through conduit means 42 and back to tank 6 through conduit 44, thereby warming the cooling water in tank 6. A predetermined time after pump 62 has been turned on, the evaporator fan 46 is turned on, blowing air through the duct system 4 over the evaporator coil 2. Conduits 42 and 44 are insulated to prevent any unnecessary loss of temperature in the system. When the cooling air blown through the duct system 4 brings the air surrounding temperature sensor 84 back to the temperature desired, the temperature sensor 84 will turn off pump 62.

When the temperature of the cooling water in tank 6 reaches a temperature which is above that set on the temperature sensor 80, the pump 34 is turned on by the temperature control means 82. This pump 34 then pumps the desired coolant from tank 10 to the heat absorber plates 30 in tank 6 through two conduits 36 and 38 and back to tank 10 by conduit 40 to bring the cooling water in tank 6 back to its desired operating temperature. The temperature sensor 80 now senses the desired temperature and turns the pump 34 off.

During operation, the temperature of the ice in the freeze tank 8 and the liquid coolant in tank 10 is controlled by the output of the comprssor units 26 and 28. The compressor units 26 and 28 are of a standard construction and direct a coolant through the freeze plate 22 and the freeze plate 24. The compressor units 26 and 28 are turned on and off by temperature sensors 90 and 94, adjacent each freeze plate 22 and 24 to maintain the desired temperature in tanks 8 and 10.

In a construction of the air conditioning system set forth above, the freeze tank 8 was made to have a capacity of 270 gallons of water to be transformed into ice, while the inner tank 10 was made to have a capacity of 90 gallons of a coolant mixture. A coolant mixture was used which can reach −40° F. (−40° C.) without freezing. The tank 6 was made for a capacity of 90 gallons of water to be used as a coolant. Heat absorber plates 30 were made having a capacity of 9 gallons of the coolant mixture which is also contained in tank 10.

It was determined that this air conditioning system would need to produce approximately 30,000 BTU's of cooling during a peak hour. The amount of cooling needed for a specific house or building in a given location is readily determined by one skilled in the art of air conditioning. The temperature of the water to be used as a coolant in tank 6 had its desired output selected at a range of 34° F. to 36° F. (1.11° C. to 2.22° C.). An evaporator coil 2 was used in which 30 gallons of water flowing therethrough at approximately 34° F. (1.11° C.) would produce the desired amount of BTU's of cooling per hour. The liquid volume control 54 was set to achieve the desired flow rate of 30 gallons of water coolant per hour. As the temperature of the water coolant reached 36° F. (2.22° C.), the temperature sensor 80 would turn on pump 34, circulate the coolant therein, and bring the water in tank 6 back to 34° F. (1.11° C.).

The temperature sensors 90 and 94 were set to turn on the compressor units 26 and 28 when a reading of −30° F. (28.88° C.) was reached. The compressor units 26 and 28 were of the standard type rated at ½ horsepower and were designed to have the freeze plates 22 and 24 reach a temperature of −40° F. (−40° C.). It is noted that in this construction that tank 6 had a capacity of three times the hourly flow rate of coolant water flowing through the evaporator coil 2; that is, while 30 gallons of water were set to flow through the evaporator coil 2 per hour, the tank 6 held 90 gallons of coolant water. Further, the capacity of the heat absorber plates 30 in tank 6 had a capacity of 9 gallons of the coolant supplied from tank 10, while tank 10 was rated at 90 gallons, this ratio being 10 to 1. It is also noted that freeze tank 8 had 3 times the capacity of coolant tank 10. A conventional air conditioning system to produce approximately 30,000 BTU's of cooling an hour would take b 2½ horsepower.

I claim:

1. An air conditioning system having a freeze tank, a first coolant tank positioned within said freeze tank, means for freezing a liquid in said freeze tank around said first coolant tank and cooling a liquid in the first coolant tank to a desired temperature, a second coolant tank, heat absorber plates being positioned within said second coolant tank, means connecting said first coolant tank to said heat absorber plates for pumping a cooled liquid in the first coolant tank through said heat absorber plates and back into said first coolant tank, an evaporator coil, means connecting said second coolant tank to said evaporator coil for pumping a cooled liquid in the second coolant tank through said evaporator coil and back into said second coolant tank.

2. A combination as set forth in claim 1 having a a duct means for delivering a flow of air to a particular location, said evaporator coil being located in said duct means, an evaporator fan being positioned in said duct means for blowing air in said duct means over said evaporator coil to cool the flow of air to a particular location.

3. A combination as set forth in claim 1 wherein said means for freezing a liquid in said freeze tank and for cooling a liquid in said first coolant tank comprises a first freeze plate means located adjacent the top of said first coolant tank and a second freeze plate means located adjacent the bottom of said first coolant tank, means for cooling said first and second freeze plate means.

4. A combination as set forth in claim 1 wherein said freeze tank has a capacity of at least three times the capacity of the first coolant tank when the first coolant tank is positioned in the freeze tank.

5. A combination as set forth in claim 1 wherein said second coolant tank has a capacity of at least three times the flow through said evaporator coil per hour.

6. A combination as set forth in claim 1 wherein the capacity of said first coolant tank is at least ten times the capacity of said heat absorber plates in said second coolant tank.

7. A combination as set forth in claim 1 wherein said means connecting said second coolant tank to said evaporator coil includes a control means to control the desired volume of fluid flow therethrough.

8. A combination as set forth in claim 1 wherein said means connecting said second coolant tank to said evaporator coil includes a first conduit means connected between said second coolant tank and said evaporator coil to deliver a coolant from said second coolant tank to said evaporator coil and a second conduit means connected between said evaporator coil and said second coolant tank to deliver a coolant from said evaporator coil to said second coolant tank, one of said conduit means having control means to control flow therethrough, and a pump means in one of said conduit means.

9. A combination as set forth in claim 1 wherein a liquid in the first coolant tank is a liquid which will reach temperatures below the freezing temperature of a liquid in the freeze tank without freezing.

* * * * *